US010392920B2

(12) United States Patent
Izuhara et al.

(10) Patent No.: US 10,392,920 B2
(45) Date of Patent: Aug. 27, 2019

(54) METHOD AND SYSTEM OF QUANTITATIVE CEMENT EVALUATION USING LOGGING WHILE DRILLING

(71) Applicant: Schlumberger Technology Corporation, Sugar land, TX (US)

(72) Inventors: Wataru Izuhara, Inagi (JP); Hiroshi Hori, Sagamihara (JP); Vivian Pistre, Meguro-ku (JP); Toshihiro Kinoshita, Sagamihara (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 641 days.

(21) Appl. No.: 14/558,560

(22) Filed: Dec. 2, 2014

(65) Prior Publication Data

US 2015/0168581 A1 Jun. 18, 2015

Related U.S. Application Data

(60) Provisional application No. 61/912,446, filed on Dec. 5, 2013.

(51) Int. Cl.
*E21B 47/00* (2012.01)

(52) U.S. Cl.
CPC ..... *E21B 47/0005* (2013.01)

(58) Field of Classification Search
CPC ..... E21B 47/0005; G01V 1/48
USPC ..... 702/9, 6, 23, 103
See application file for complete search history.

(56) References Cited

U.S. PATENT DOCUMENTS

| | | | | |
|---|---|---|---|---|
| 4,703,427 | A | 10/1987 | Catala et al. | |
| 4,757,479 | A | 7/1988 | Masson et al. | |
| 4,802,145 | A * | 1/1989 | Mount, II | E21B 47/0005 181/105 |
| 2006/0262644 | A1 | 11/2006 | Schoepf et al. | |
| 2007/0206439 | A1* | 9/2007 | Barolak | E21B 47/0005 367/35 |
| 2008/0112262 | A1* | 5/2008 | Tang | E21B 47/0005 367/35 |
| 2010/0126718 | A1* | 5/2010 | Lilley | E21B 47/0005 166/253.1 |

(Continued)

FOREIGN PATENT DOCUMENTS

| | | |
|---|---|---|
| EP | 0263028 | 9/1986 |
| EP | 0443936 | 8/1991 |
| WO | 2013/096565 | 6/2013 |

OTHER PUBLICATIONS

"Identifying Top of Cement While Drilling Saves 1½ Days of Rig Time—Case Study: Sonic Scope 475 service helps operators save additional rig time for cement evaluation," Schlumberger, 2010 at www.slb.com/SonicScope.

(Continued)

*Primary Examiner* — Tan T. Nguyen

(57) ABSTRACT

A method of quantitative cement evaluation is provided. The method includes deploying a logging-while-drilling downhole sonic tool into a wellbore inside a casing, measuring acoustic signals propagating through the casing with the logging-while-drilling downhole sonic tool, and performing quantitative cement evaluation with respect to cement bonding around the casing by using waveform data of the acoustic signals measured with the logging-while-drilling downhole sonic tool.

15 Claims, 6 Drawing Sheets

(56) References Cited

U.S. PATENT DOCUMENTS

| | | | | |
|---|---|---|---|---|
| 2014/0052376 | A1* | 2/2014 | Guo | E21B 47/0005 702/11 |
| 2014/0177389 | A1* | 6/2014 | Bolshakov | E21B 47/0005 367/35 |
| 2014/0236357 | A1 | 8/2014 | Degrange | |

OTHER PUBLICATIONS

"Sonic Scope 475 Top-of-Cement Identification—Using multipole sonic-while-drilling service," Schlumberger Fact Sheet, 2010 at www.slb.com/SonicScope.

"Top-Of-Cement (TOG) Evaluation Saves Rig Time—Case Study: Sonic Scope 475 relogged inside casing helps interpret cement bonding and free pipe zones," Schlumberger, 2010 at www.slb.com/SonicScope.

M. Blyth, et al., "LWD Sonic Cement Logging: Benefits, Applicability and Novel Uses for Assessing Well Integrity," SPE/IADC 163461, SPE/IADC Drilling Conference and Exhibition, Mar. 5-7, 2013.

M. Grosmangin, et al., "A Sonic Method for Analyzing the Quality of Cementation of Borehole Casings," Journal of Petroleum Technology, vol. 13, No. 2, 1961, pp. 165-171.

J. Degrange et al., "Sonic While Drilling: Multipole Acoustic Tools for Multiple Answers," IADC/SPE 128162, IADC/SPE Drilling Conference and Exhibition, Feb. 2-4, 2010.

C.V. Kimball, et al., "Semblance processing of borehole acoustic array data," Geophysics, 49, 1984, pp. 274-281.

T. Kinoshita, et al., "Feasibility and Challenge of Quantitative Cement Evaluation with LWD Sonic," SPE 166327, SPE Annual Technical Conference and Exhibition, Sep. 30-Oct. 2, 2013.

J. Longo, et al., "Logging-While-Drilling Cement Evaluation: A Case Study from the North Slope, Alaska," SPE 159819, SPE Annual Technical Conference and Exhibition, Oct. 8-10, 2012.

E. Nelson and D. Guillot, 2006, "Well Cementing Second Edition," Schlumberger.

G.H. Pardue, et al., "Cement Bond Log—A Study of Cement and Casing Variables," Journal of Petroleum Technology, vol. 15, No. 5, 1963, pp. 545-554, SPE paper 453.

* cited by examiner

METHOD AND SYSTEM OF QUANTITATIVE CEMENT EVALUATION USING LOGGING WHILE DRILLING

This application is based upon and claims the benefit of the priority of U.S. Provisional Application Ser. No. 61/912,446 entitled "Method Of Quantitative Cement Evaluation Using Logging While Drilling" filed on Dec. 5, 2013, the disclosure of which is incorporated herein in its entirety by reference thereto.

BACKGROUND

The present disclosure relates generally to wellsite operations. In particular, the present disclosure relates to techniques for forming and/or cementing wellbores.

Wellbores are drilled to locate and produce hydrocarbons. A downhole drilling tool with a bit at an end thereof is advanced into the ground to form a wellbore. As the drilling tool is advanced, drilling mud is pumped through the drilling tool and out the drill bit to cool the drilling tool and carry away cuttings.

The wellbore may be completed in preparation for production. During completion, the wellbore may be provided with cement to line the wellbore and to secure casing in the wellbore. Production equipment may be positioned about the wellbore to draw subsurface fluids, such as hydrocarbons, to the surface.

During various wellbore operations, fluids and/or materials, such as drilling muds and cements, may be placed in the wellbore. Downhole tools may be provided to test and/or sample the surrounding formation and/or fluids contained in reservoirs therein. For example, the drilling tool may be provided with measurement while drilling and/or logging-while-drilling tools to measure formation parameters. In another example, a wireline tool may be deployed into the wellbore to take measurements and/or collect fluid samples from the formation.

Various measurements may be taken by the downhole tools. Examples of measurements are provided in Patent/Publication Nos. WO2013096565, US20060262644, EP0443936, EP0263028, and U.S. Pat. No. 4,703,427; and U.S. application Ser. No. 13/771,086 filed on Feb. 20, 2013 entitled, Cement Data Telemetry Via Drill String by DeGrange et al., the entire contents of which are hereby incorporated by reference herein. Examples of cement related technology are provided in Blyth, M., Hupp, D., Whyte, I., and Kinoshita, T., 2013, LWD Sonic Cement Logging: Benefits, Applicability and Novel Uses for Assessing Well Integrity, SPE/IADC 163461, SPE/IADC Drilling Conference and Exhibition, 5-7 March; Grosmangin, M., Kokesh, F. P., and Majani, P., 1961, A Sonic Method for Analyzing the Quality of Cementation of Borehole Casings, Journal of Petroleum Technology, Vol. 13, No. 2, 165-171; Degrange J., Hawthorn, A., Nakajima, H., Fujihara, and T., Mochida, M., 2010, Sonic While Drilling: Multipole Acoustic Tools for Multiple Answers, IADC/SPE 128162, IADC/SPE Drilling Conference and Exhibition, 2-4 February; Kimball, C. V and Marzetta, T. L., 1986, Semblance processing of borehole acoustic array data, Geophysics, 49, 274-281; Kinoshita, T., Izuhara, W., Valero, H. P., and Blyth, M., 2013, Feasibility and Challenge of Quantitative Cement Evaluation with LWD Sonic, SPE 166327, SPE Annual Technical Conference and Exhibition, 30 September-2 October; Longo, J., Hupp, D., Blyth, M., and Alford, J., 2012, Logging-While-Drilling Cement Evaluation: A Case Study from the North Slope, Ak., SPE 159819, SPE Annual Technical Conference and Exhibition, 8-10 October; Nelson, E. and Guillot, D., 2006, Well Cementing Second Edition, Schlumberger; and Pardue, G. H., Morris, R. L., and Gollwitzer, L. H., 1963, Cement Bond Log-A Study of Cement and Casing Variables, Journal of Petroleum Technology, Vol. 15, No. 5, 545-554, SPE paper 453, the entire contents of which are hereby incorporated by reference herein.

SUMMARY

In at least one aspect, the present disclosure relates to a method of quantitative cement evaluation using a logging-while-drilling downhole sonic tool. The method may include deploying a logging-while-drilling downhole sonic tool into a wellbore inside a casing, measuring acoustic signals propagating through the casing with the logging-while-drilling downhole sonic tool, and performing quantitative evaluation with respect to cement bonding around the casing by using waveform data of the acoustic signals measured with the logging-while-drilling downhole sonic tool.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the method and system of quantitative cement evaluation using a logging-while-drilling downhole sonic tool are described with reference to the following figures. The same numbers are used throughout the figures to reference like features and components.

DETAILED DESCRIPTION

The description that follows includes exemplary apparatuses, methods, techniques, and instruction sequences that embody techniques of the inventive subject matter. However, it is understood that the described embodiments may be practiced without these specific details.

The present disclosure relates to quantitative cement evaluation using, for example, a logging-while-drilling downhole sonic tool. The quantitative cement evaluation involves performing a workflow to quantitatively determine cement parameters using normalized parameter setting, providing a cementing evaluation plots that indicates whether a measured signal is affected by an extensional mode (e.g., collar arrival) which is a propagating mode of acoustic signals in the tool, and time-lapse measurement throughout the cementing process.

Quantitative cement evaluation may be performed in all applications, including difficult applications which may involve, for example, top of cement (TOC) without bonding conditions, tool conveyance in even highly-deviated or horizontal wells, and/or large casing applications where a wireline signal may be too weak. Quantitative cement evaluation may be performed using logging-while-drilling (LWD) downhole sonic tools to save rig costs that may result from additional wireline logging or Tough Logging Conditions (TLC) time, and/or to avoid tool eccentering and bending issues with using proper stabilizers for LWD applications.

Figure 1:
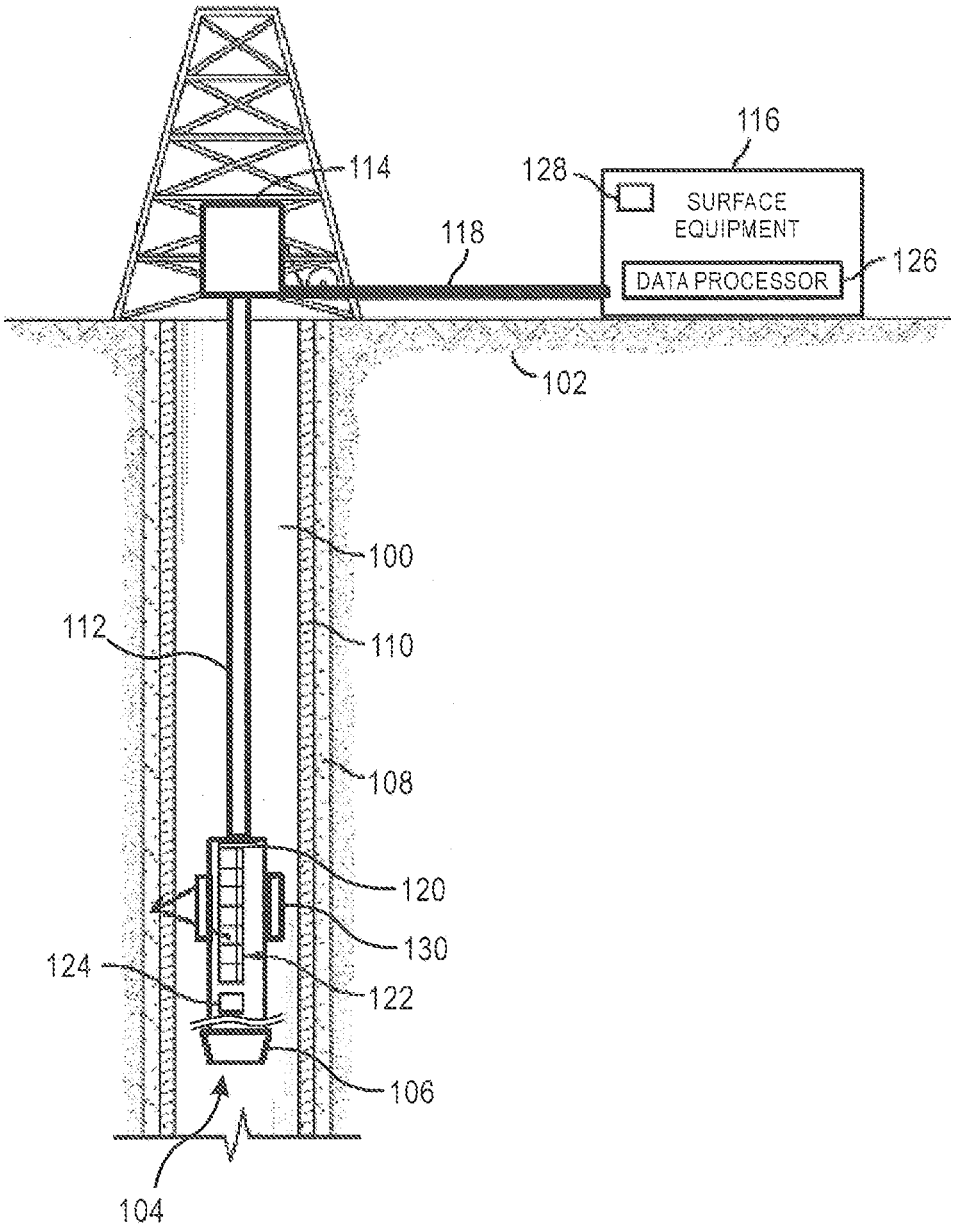
FIG. 1 is a schematic view, partially in cross-section, of a wellsite with a system for quantitative cement evaluation including a logging-while-drilling downhole sonic tool in accordance with embodiments of the present disclosure.

FIG. 1 depicts an example environment that may be used for performing cement measurements. As shown, a wellbore 100 may be drilled into a subterranean formation 102 by a logging-while-drilling downhole tool or a series of the logging-while-drilling & measurement-while-drilling downhole tools (hereinafter called as LWD and/or MWD downhole tool) 104 having a drill bit 106 at the bottom end thereof, and a cement 108 is disposed into the wellbore 100 to secure a casing 110 along an inner surface of the wellbore 100. The LWD downhole tool 104 may be deployed into the wellbore 100 by a drill-pipe string 112 and driven by rig equipment 114.

The drill-pipe string 112 may be operatively connected to a surface equipment 116 by link 118 for providing communication between the LWD downhole tool 104 and the surface equipment 116 via an MWD downhole tool. The LWD downhole tool 104 may have telemetry 120 for communicating with the surface equipment 116 via an MWD downhole tool. The telemetry 120 may be mud pulse, electromagnetic, or other telemetry coupled by link 118 (or other means) to the surface equipment 116. The LWD downhole tool 104 may also be provided with an array 122 that includes a plurality of axially spaced acoustic transducers to measure acoustic signals propagating in the casing 110 and a downhole controller 124 to operate the array 122. The surface equipment 116 may be provided with a data processor 126 and a controller 128 to communicate with and/or control the LWD downhole tool 104.

Measurements may be taken using the LWD downhole tool 104 in a recorded mode or data processing. Waveforms generated by the measurements may be stored in downhole tool memory. The waveforms may also be generated at the surface in real-time and/or data processing performed while drilling. For example, the downhole controller 124 may be provided with processors or other devices to perform part or all of the cement evaluation downhole using dedicated signal processors.

Selected data obtained by the measurements may be transmitted to the surface using the telemetry 120. Data can be compressed if necessary. For instance, casing amplitude may be detected downhole and transmitted to the surface for further analysis. Some pre-set parameters may be prerecorded prior to deploying the tool downhole. Data transmission may be performed using a variety of methods and/or apparatus. See, for example, DeGrange, previously incorporated by reference herein, which describes more details about data transmission for cement evaluation in real-time mode.

The LWD downhole tool 104 may be, for example, a sonic LWD tool, such as SONICVISION™ and/or SONICSCOPE™ commercially available from SCHLUMBEGER TECHNOLOGY CORPORATION™ at www.slb.com. The LWD downhole tool 104 may be used alone or in conjunction with wireline sonic tools, such as those described in WO2013096565, previously incorporated by reference herein.

While FIG. 1 shows a vertical well, the logging while drilling may also be performed in special wellbore applications, such as non-vertical, deviated, highly deviated and/or horizontal wellbores (referred to herein as deviated), time limited applications, and/or in enlarged wellbores. In at least some cases, the LWD version of the downhole tool 104 may be needed to maneuver through and measure in deviated wellbore applications. The LWD downhole tool 104 may be used in applications where there is insufficient time to deploy a wireline tool.

In at least some cases, the LWD downhole tool 104 may also be needed to measure in enlarged wellbores where a low or attenuated signal may not properly measure due to an annular space between the tool body and the casing 110 that is too large for measurement by other tools (e.g., wireline). The LWD downhole tool 104 may be provided with stabilizers (and/or centralizers) 130 to position the LWD downhole tool 104 within the wellbore 100 and prevent eccentering therein. The LWD downhole tool 104 may have a relatively large tool outer diameter that is close to an inner diameter of the casing 110 and positionable adjacent the casing 110 even in large casing. The array 122 may be used to excite a large acoustic energy in the casing 110.

The LWD downhole tool 104 may be used to provide qualitative and/or quantitative evaluation of the cement 108. Qualitative evaluation may be performed using, for example Top of Cement (TOC) evaluation commercially available from SCHLUMBEGER TECHNOLOGY CORPORATION™ at www.slb.com, and described in Degrange et al., 2010 and Longo et al., 2012, previously incorporated by reference herein. The qualitative evaluation may be used for cement evaluation by the LWD downhole tool 104, even in cases involving top of cement and/or without bonding condition.

The LWD downhole tool 104 may also be used for quantitative evaluation of the cement 108 as is described herein. Wireline quantitative cement evaluation may be performed using a Cement Bond Log (CBL) and Discriminated Cement Bond Log (DCBL) using wireline sonic services. A limited-quantitative cement evaluation using a data processing method with an LWD downhole tool may also be performed with techniques as described by Blyth et al., 2013, previously incorporated herein. In some cases, the limited-quantitative measurement may require further definition of measurement limitation under the presence of strong tool mode that affects casing mode used for the quantitative cement evaluation. The tool mode is a propagation mode of acoustic signals in the tool body, which is called as "tool extensional mode", "extensional mode", or "collar arrival" elsewhere herein, and the casing mode is a propagation mode of acoustic signals through the casing.

Quantitative cement evaluation may be performed using LWD alone or in conjunction with other cement evaluation, such as wireline Cement Bond Log (CBL), limited-quantitative cement evaluation, and/or other qualitative and/or quantitative cement evaluation techniques. Quantitative measurements may be used, for example, where there is a technical difficulty related to an extensional mode propagating of acoustic signals in the downhole logging tool. Quantitative cement evaluation may be performed by extraction from data recorded using, for example, the LWD downhole tool 104. In some cases, the tool mode of the LWD downhole tool 104 may contaminate waveforms acquired at receivers and affect cement evaluation (see, e.g., Kinoshita et al., 2013, previously incorporated by reference herein).

The quantitative measurements may be used, for example, to attenuate the tool mode enough to cover a range of bonding ratio and cement types, and/or to separate the tool mode from the casing mode in the acquired waveforms, for example, where the tool mode has very similar speed and frequency content to the casing mode. The quantitative measurements may also be used to analyze measurements in relation to cement bonding ratios. Such quantitative evaluation by the LWD downhole tool may be defined in terms of a processing method and how to identify where the limitation of the measurement is without a wireline reference.

The LWD quantitative cement evaluation may be used to evaluate bonding conditions even in cases with transmitter-receiver (T-R) spacing of LWD sonic tools that is longer than about 3 ft (0.91 m). The quantitative cement evaluation may be used with quality control plots for validation of the evaluation, and to define the a range of application of the methodology and the technical limitation in terms of casing to cement bonding condition and type of cement behind casing which may be limited by the tool extensional mode.

Figure 2A:
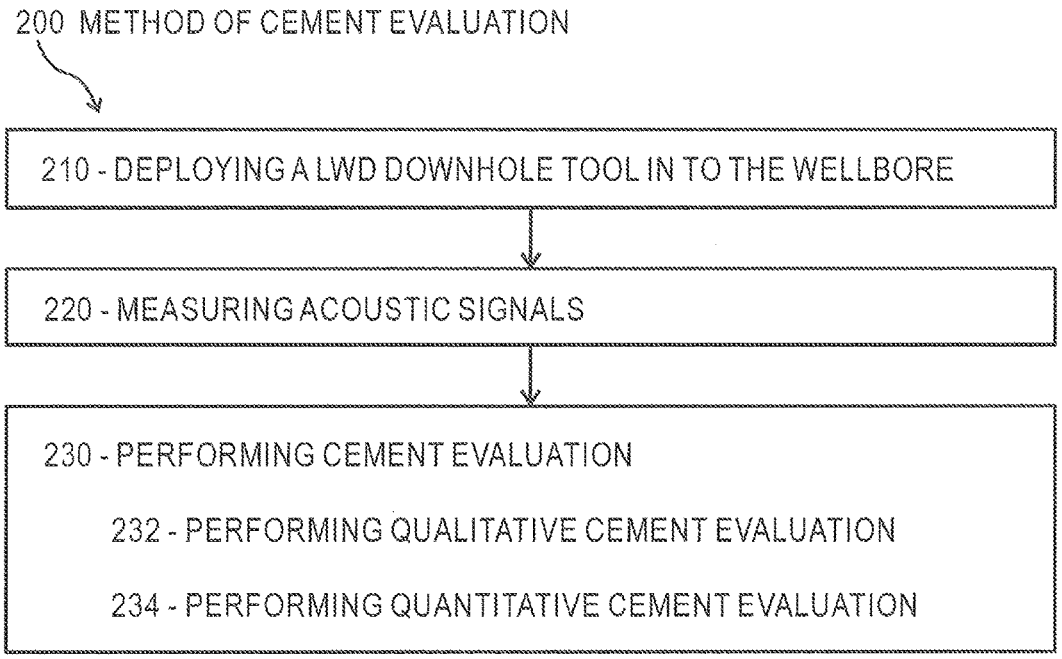
FIG. 2A is a flow chart illustrating a method of cement evaluation in accordance with embodiments of the present disclosure.

FIG. 2A is a flow chart depicting a method (200) of cement evaluation. The method (200) involves deploying (210) an LWD downhole tool into a wellbore inside a casing and measuring (220) acoustic signals propagating through the casing with the LWD downhole tool. The deploying (210) may be performed using an LWD downhole tool alone as shown in FIG. 1, and/or in combination with a wireline tool. The acoustic waveform signals may then be received by the LWD downhole tool 104 and collected at the surface by the surface equipment 116 (refer to FIG. 1).

The method (200) also involves performing (230) cement evaluation. The performing (230) cement evaluation optionally may involve performing (232) qualitative evaluation. The qualitative analysis may be performed using wireline CBL as described previously with an amplitude normalization conducted in a free pipe section of the wellbore.

The performing (230) cement evaluation also involves performing (234) quantitative cement evaluation. The quantitative cement evaluation may be performed using the LWD downhole tool 104 (see e.g. FIG. 1).

Figure 2B:
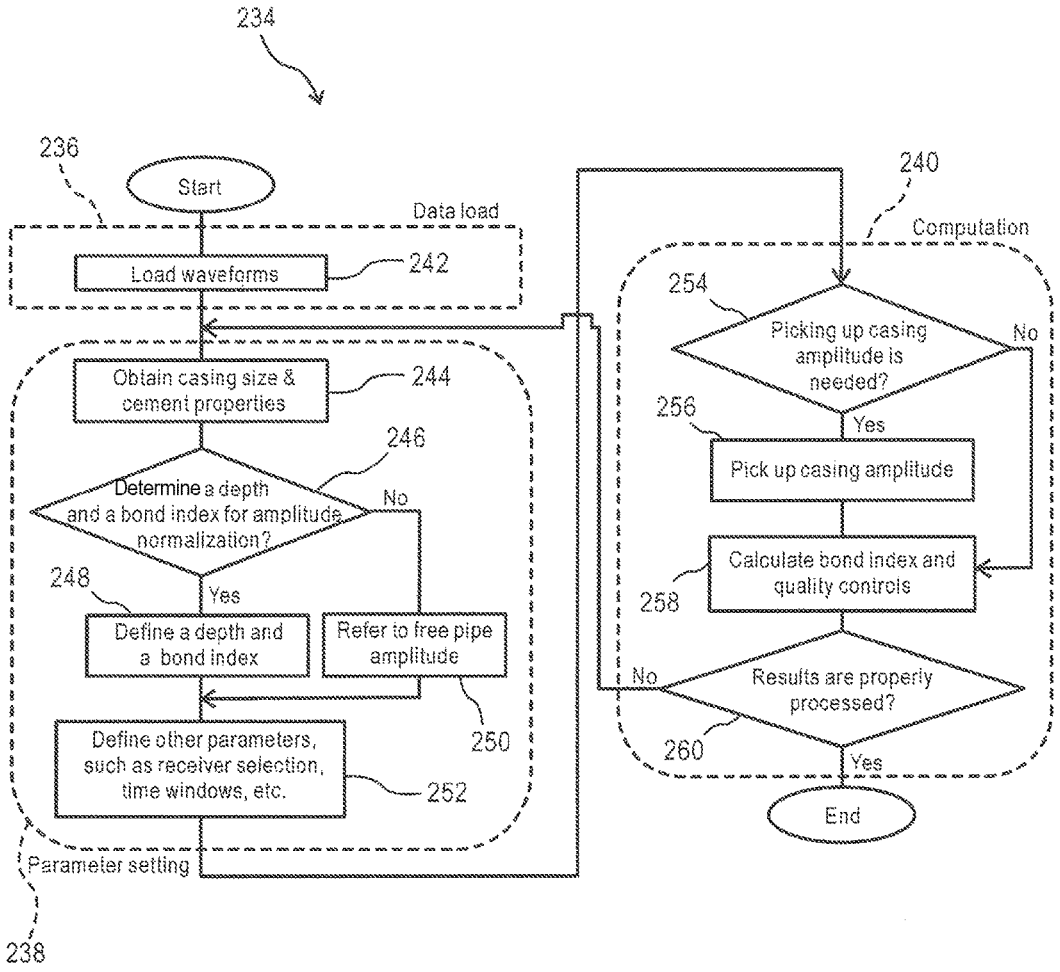
FIG. 2B is a flow chart illustrating a method of quantitative cement evaluation in accordance with embodiments of the present disclosure

FIG. 2B is a flow chart depicting a method of quantitative cement evaluation. The performing (234) quantitative cement evaluation involves loading (236) data of acoustic waveforms measured with the LWD downhole tool, setting (238) parameters for quantitative cement evaluation (amplitude normalization), and determining (240) cement parameters (e.g., bond index and quality controls) for the quantitative cement evaluation by computing with the data and parameters. The loading (236) data involves loading (242) waveforms generated, for example, by the LWD tool during the measurement (220).

The setting (238) parameters involves obtaining (244) operational properties (e.g., casing size and cement properties), and determining (246) if a depth for amplitude normalization is derived from the data. If so, then the properties, such as depth and bond index, may be defined (248). If not, other properties, such as a free pipe amplitude that is an estimated amplitude of acoustic signal propagating through a casing without cement therearound, may be used. Next, other wellsite parameters, such as receiver selection, time window, etc., are defined (252).

The parameter setting (238) provides an amplitude normalization of the LWD application. This normalization may be conducted under arbitrary cement bond conditions, for example, in case no free pipe interval is present. Certain parameters, such as bond index, used in the normalization during parameter setting (238) may be defined by referring to the bond index by attenuation based on quality plots.

Bond index is a quantitative indicator of the adherence of the cement to the casing or the fraction of casing circumference bonded by cement.

Figure 3:
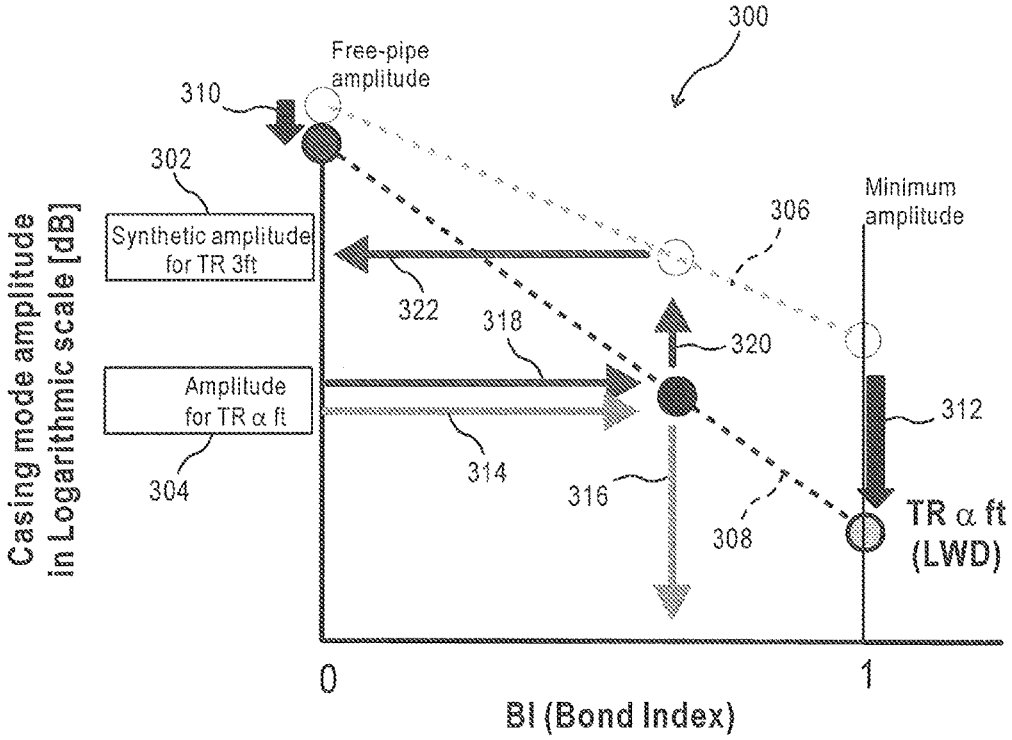
FIG. 3 is a graph illustrating casing amplitude versus bond index in accordance with embodiments of the present disclosure.

FIG. 3 is a graph 300 depicting a relationship between casing amplitude (A) set to a y-axis in logarithmic scale and bond index (BI) set to an x-axis. The casing amplitude (A), which is also called as "casing mode amplitude" elsewhere herein, is amplitude of an acoustic signal propagating through the casing 110 and detected with the array 122 of the LWD downhole tool. The bond index (BI) is a calculatable value which is the key to the quantitative interpretation of cement evaluation and a measure of cement bond based on the casing amplitude. For example, the bond index (BI) is defined by dividing an attenuation rate in zone of interest [dB/ft] by an attenuation rate in well cemented zone [dB/ft].

The graph 300 in FIG. 3 depicts a model between casing mode amplitude (A) (y-axis) and bond index (BI) (x-axis) for a synthetic amplitude 362 and a real casing amplitude 364. The synthetic amplitude 362 as shown in this example is a casing amplitude for a standard T-R of 3 ft (0.91 m) converted from the real casing amplitude 364 measured with the LWD downhole tool with longer T-R of $\alpha$ ft.

The quantitative evaluation may involve conversion to a standard Cement Bond Log (CBL) amplitude by estimating equivalent casing amplitude as CBL using a longer transmitter-receiver spacing (e.g., wireline CBL log has specification of signal level obtained from a receiver positioned with spacing of 3 ft (0.91 m) from a transmitter). An equivalent casing amplitude converted from the measured casing amplitude may be estimated as CBL (T-R of 3 ft (0.91 m)) with longer T-R spacing of LWD sonic tools.

The graph 300 provides a model for cement evaluation with longer T-R spacing (e.g., greater than about 3 ft (0.91 m)). The dashed line 306 as a standard characteristic line indicates conventional wireline CBL model with a T-R spacing of 3 ft (0.91 m). A T-R spacing of 3 ft (0.91 m) or more may affect the ability to use the CBL model to derive bond index from LWD sonic amplitude. The dashed line 308 as a real characteristic line represents the model developed for the LWD downhole tool with T-R spacing of $\alpha$ ft longer than 3 ft (0.91 m). The model shows that the casing signal magnitude (logarithm of casing amplitude) is more attenuated for larger T-R spacing. For example when T-R spacing is 7 ft (2.13 m), a casing amplitude reduction factor from T-R 3 ft (0.91 m) spacing can be computed as the product of attenuation rate (in dB/ft) of given cement bond conditions and 4 ft (1.22 m) of extra-spacing. The characteristic line 308 of T-R 7 ft (2.13 m) model can be computed from T-R 3 ft (0.91 m) free pipe (Bond index=0) and full bond (Bond index=1) amplitude and respective attenuation rate, as shown by the black arrows 310 and 312 based on the characteristic line 306 for the conventional wireline CBL model with a T-R spacing of 3 ft (0.91 m).

Using the T-R 7 ft (2.13 m) model line 308, the bond index may be estimated using the casing amplitude obtained from the LWD downhole tool as shown by the arrows 314 and 316. From the resulting bond index, the T-R 7 ft (2.13 m) amplitude 304 can be converted to a synthetic CBL amplitude (normalized amplitude) 302 at TR 3 ft (0.91 m) spacing as shown by the arrows 318-322.

Referring back to FIG. 2B, the computation for determining (240) cement parameters may involve determining (254) if picking up a casing amplitude is needed. If so, then the casing amplitude is picked up (256) before calculating (258)

cement parameters, such as bond index and quality controls. If not, the picking up (258) casing amplitude may be omitted. The results of calculation may be checked to determine (260) if the results were properly processed. If so, the performing computation for determining (240) cement parameters is completed. If not, the setting (238) parameters and determining (240) cement parameters may be repeated.

The checks (260) may be performed to validate the results. Various factors may affect the quality of the cement evaluation. For example, the amplitude of tool extensional mode, which is due to arrival of acoustic signal propagating in a collar of the LWD downhole tool, may be larger than the casing amplitude due to arrival of acoustic signal propagating through the casing, when cement bonding is good with some type of cement. Quality control plots for the cement evaluation with the LWD downhole tool may be used to determine if a measured signal is affected by the extensional mode (collar arrival) propagating in the LWD downhole tool. The quality control plots may also be used for determining and/or confirming certain parameters, such as bond index.

Figure 4:
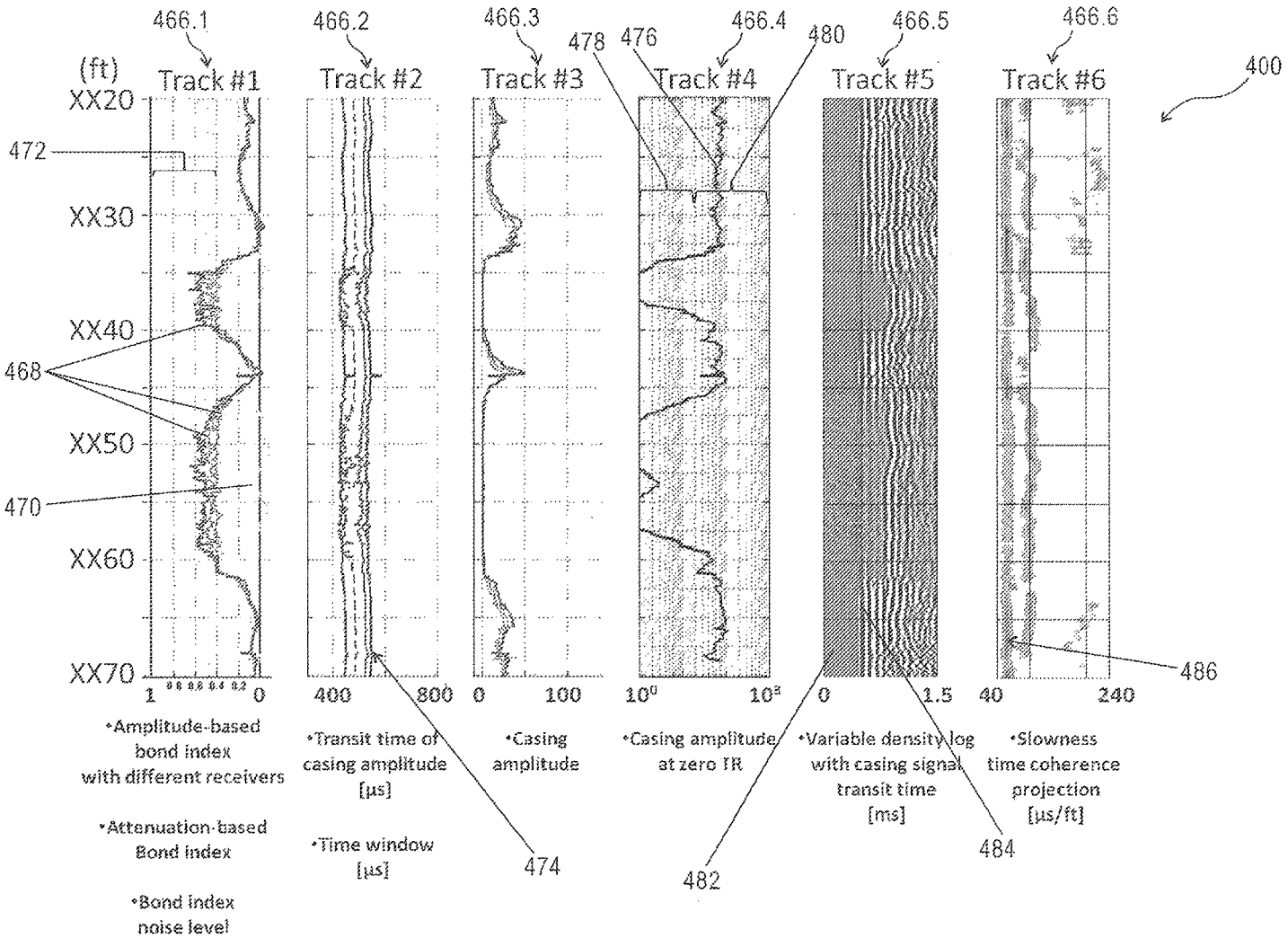
FIG. 4 is a chart depicting various outputs of a logging-while-drilling downhole sonic tool in accordance with embodiments of the present disclosure.

FIG. 4 includes an output 400 including quality control plots generated for the LWD quantitative cement evaluation. These plots may be examined and/or analyzed to determine whether the cement evaluation is valid. As shown in this example, a graphical view of quality controls may be provided for the LWD quantitative cement evaluation. The output 400 shows logging tracks 466.1-466.6 (tracks 1-6). Track 466.1 depicts amplitude-based bond index with different receivers, attenuation based bond index, and bond index noise level; track 466.2 depicts transit time of casing amplitude and time window [μs]; track 466.3 depicts casing amplitude; track 466.4 depicts casing amplitude at zero T-R; track 466.5 depicts variable density log with casing signal transit time [ms]; and track 466.6 depicts slowness time coherence projection [μs/ft]. One or more combinations of various tracks may be selected for viewing.

Based on the quality control plots, the calculated bond index log may be evaluated to confirm reliability and/or to determine if the bond index is affected by tool mode. The amplitude based bond index may be considered in the evaluation. The amplitude-based bond index may be determined by using the casing amplitude recorded at various receivers in the array 122. If all match within a given range, the calculated bond index may be considered reliable. If not, the values of bond index may be considered unreliable, possibly due to low waveform quality and/or to the tool mode presence. Adjustments at the wellsite may be made, if necessary. Examples of agreement/disagreement of bond index curves may be computed respectively for multiple (e.g., three different) T-R spacing receivers 468 as shown in track 466.1 and presented in three lines 468 with mutually different image densities.

The attenuation based bond index may also be considered in the evaluation. An alternative bond index value can be computed from the casing mode attenuation and from the casing amplitude signal recorded along the receiver array. The comparison of the two different bond indices, respectively from casing amplitude and attenuation, may be used to indicate the limitation of quantitative LWD cement evaluation where a large discrepancy is observed when the actual bond index is above the limit of the LWD tool measurements. The attenuation based bond index may also be used as a reference to normalize the casing amplitude approach. Attenuation-based bond index is shown in a gray line 470 in Track 466.1 of FIG. 4, for example, when there is no free pipe zone through the entire casing section.

Bond index noise level may also be considered in the evaluation. Background noise amplitude is converted to equivalent bond index value using the same formula that relates casing amplitude to bond index. If the bond index from casing amplitude decreases below this noise level, the quantitative cement evaluation may be affected by noise and invalid. See, for example, a light gray area 472 in Track 466.1 of FIG. 4.

Transit time of casing amplitude and time window position may also be considered in the evaluation. A detection time window and the internal solid and dashed curves 474 present the detected transit time as shown in track 466.2. These may be useful to know the effect of the background noise and measurement limitations. When the casing amplitude is large enough, the time window and transit time curves may be stable and flat along depth. When the casing amplitude is comparable or smaller than the tool arrival, detection tends to pick acoustic signals propagating in the LWD downhole tool (tool propagations) that arrive earlier than casing signals of acoustic signals propagating through the casing, and the transit time is shifted. Fluctuation of transit time may indicate unreliable measurements of casing amplitude smaller than noise amplitude.

The casing amplitude may also be considered in the evaluation. The casing amplitude is presented in Track 466.3 and the casing amplitude at zero T-R spacing is depicted in track 466.4. Theoretical casing amplitude at zero T-R spacing can be computed using receiver array amplitude and attenuation through array receivers with the following equation.

$$SA_0 = SA_\alpha \times 10^{ATT \times TR_\alpha / 20} \qquad \text{Eqn. 1}$$

where SA is casing amplitude, ATT is attenuation rate in casing mode and TR is T-R spacing of the receiver. Subscript 0 and $\alpha$ respectively indicate the value at the T-R spacing of zero and $\alpha$. Casing amplitude at zero spacing is an indicator of measurements quality as it is representative of the energy imparted to the casing in front of the transmitter.

The amplitude $SA_0$ may be relatively high when a cement bond is within the LWD measurement limit. When the cement bond is above the LWD measurements limit, the amplitude may decrease below a value specific to the tool design. Example data of casing amplitude at zero T-R spacing is presented as a black curve 476 in Track 466.4 of FIG. 4. The amplitude value below and above the LWD tool limit is indicated as area 478 and area 480 in Track 466.4 of FIG. 4, respectively.

Variable density log (VDL) with casing signal transit time may also be considered in the evaluation. Track 466.5 of FIG. 4 presents an example VDL and transit time log. Similar to the wireline CBL-VDL log, monopole modal pressure waveforms acquired in VDL image may be presented. A time-sampled waveform is mapped to gray area 482 in logarithmic scale and presented as an image along the horizontal time axis. Unlike the wireline VDL signals recorded at 5 ft (1.52 m) T-R spacing, the LWD-VDL may be recorded at the shortest T-R spacing in receiver array which is longer than 5 ft (1.52 m) and may depend on the design of the LWD sonic tool (e.g. 7 ft (2.13 m) T-R spacing in FIG. 4).

The transit time in curve 484 of track 466.5 may be overlaid on top of VDL to QC casing signal detection. This display may be useful to visually control the quality of casing to cement bond appearing as strong straight line at the beginning of the wavetrain and cement to formation bond as the formation signal is evident on the display.

Slowness time coherence (STC) projection may also be considered in the evaluation. Track 466.6 of FIG. 4 presents slowness-time coherence projection of array receiver waveforms that is computed using a semblance coherence method (see, e.g., Kimball et al. 1986, previously incorporated by reference herein). As shown with arrow 486 in track 466.6, the casing propagation is around 57 [μs/ft]. If a coherence is seen, this may be indicative of a strong casing arrival and/or poor bonding. If the casing arrival at 57 [μs/ft] is not coherent and the formation signal shows strong coherence, the cement to casing bonding may be confirmed to be strong and so is the bonding between cement and formation.

Time-lapse measurement may be performed during the method (200). Cement properties and bonding conditions may change after cementing, for example, while drilling progresses over several days in multiple runs. LWD measurements may be obtained in the cemented section at least twice, for example, while tripping in (TI) and pulling out of the hole (POOH), for each run and more if several runs are required. The LWD qualitative cement evaluation is useful to monitor significant cement bonding change. Time-lapse measurements may be taken at various intervals as desired.

One or more LWD downhole tools 104 may run through the casing 110 multiple times while tripping in or pulling out of hole (wellbore 100). The LWD downhole tool 104 may be run multiple times in a well drilling progresses, e.g. after changing drill bit. Time-lapse measurements may be conducted with LWD cement evaluation using the foregoing workflow of method (200) with the quality control indicators of FIG. 4.

Figure 5:
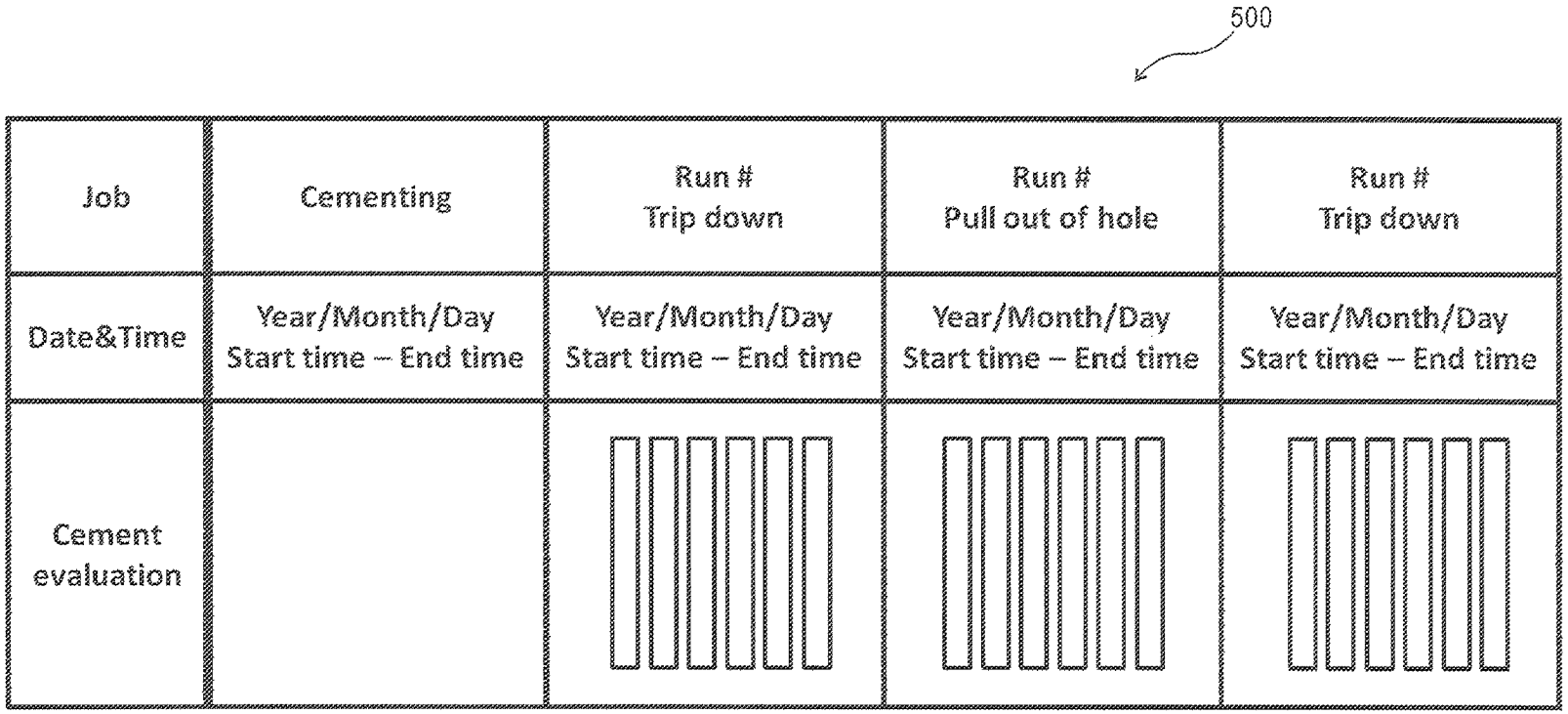
FIG. 5 is a chart depicting time lapse measurement in accordance with embodiments of the present disclosure.

FIG. 5 shows a chart 500 depicting time-lapse measurement. The time-lapse measurements are performed for various jobs, such as cementing, and number of runs during cycles of trip down and pull out of hole. The date and time and number of cement evaluations are provided. As shown by the chart 500, cement bond can be evaluated during tripping without additional rig time. The newly developed LWD cement evaluation may be used with conventional CBL-VDL. A potential poor cementing interval may be determined before drilling the next open hole section starts. Time-lapse measurements may be used to track cement bonding change after cementing job, and change of bonding condition induced by the drilling operation and induced shocks and vibrations.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method of performing a quantitative cement evaluation of cement bonding around a casing of a logging-while-drilling downhole sonic tool deployed in a wellbore, the method comprising:

accessing, by executing an instruction with a processor, waveform data of acoustic signals propagating through the casing and measured with the logging-while-drilling downhole sonic tool, the logging-while-drilling downhole sonic tool having a transmitter-receiver spacing at a first distance;

detecting, by executing an instruction with the processor, attenuation of the acoustic signals relative to a threshold based on the waveform data, the threshold based on a transmitter-receiver spacing at a second distance less than the first distance;

determining, by executing an instruction with the processor, a casing amplitude reduction factor based on an attenuation rate of a cement bond condition and an amount by which the first distance is greater than the second distance; and determining, by executing an instruction with the processor, a bond index indicative of an adherence of cement to the casing based on the waveform data and the casing amplitude reduction factor.

2. The method according to claim 1, further including setting parameters for the quantitative cement evaluation by:

obtaining data of operational properties for the cement, a size of the casing, and the measurement of the acoustic signals; and defining a depth and for amplitude normalization of the acoustic signals based on the waveform data and the data of operational properties.

3. The method according to claim 2, wherein setting the parameters for the quantitative cement evaluation comprises:

determining if a depth for the amplitude normalization of the acoustic signals is derivable from the waveform data;

defining the depth based on the waveform data and the data of operational properties, when the depth for amplitude normalization is derivable from the waveform data; and defining a free-pipe amplitude based on an amplitude of an acoustic signal propagating through a casing without cement attached to the casing, when the depth for amplitude normalization is not derived from the measured waveform data.

4. The method according to claim 1, wherein determining the bond index is further based on the measured waveform data and a real characteristic line modeling a relationship between an amplitude of the acoustic signals propagating through the casing and bond indices for a transmitter-receiver pair of the logging-while-drilling downhole sonic tool.

5. The method according to claim 4, further comprising:

detecting a casing amplitude from the waveform data, wherein the casing amplitude is an amplitude of an acoustic signal propagating through the casing; and computing a normalized amplitude of the acoustic signal propagating through the casing for the transmitter-receiver spacing at the second distance based on the waveform data, the real characteristic line, and a standard characteristic line modeling a relationship between the casing amplitude and the bond indices.

6. The method according to claim 5, further comprising determining if the casing amplitude should be detected.

7. The method according to claim 1, further comprising calculating a quality control indicator for the quantitative cement evaluation based on the waveform data; and checking the bond index based on the quality control indicator.

8. The method according to claim 7, wherein the quality control indicator is at least one of an amplitude-based bond index for a receiver different than a receiver of the logging-while-drilling downhole sonic tool, an attenuation-based bond index, a bond index noise level, an amplitude transit time, a time window, a casing amplitude, a casing amplitude at zero spacing between a transmitter and a receiver of the logging-while-drilling downhole sonic tool, a variable density log with a casing signal transit time, or a slowness time coherence projection.

9. The method according to claim 1, further comprising performing time-lapse measurements of the cement evaluation for a plurality of jobs associated with drilling the wellbore.

10. The method according to claim 9, wherein the plurality of jobs includes cementing around the casing, and tripping down and tripping up the logging-while-drilling downhole sonic tool in the wellbore.

11. A system for performing a quantitative cement evaluation, the system comprising:

a logging-while-drilling downhole sonic tool to measure acoustic signals propagating through a casing during a job associated with drilling a wellbore, the logging-while-drilling downhole sonic tool having transmitter-receiver spacing at a first distance; and a processor to:

access waveform data of the acoustic signals;

detect an attenuation of a casing amplitude from the waveform data, wherein the casing amplitude is an amplitude of a first acoustic signal propagating through the casing at the first distance;

calculate casing amplitude reduction data based on (1) a second acoustic signal propagating through the casing for a transmitter-receiver spacing at a second distance less than the first distance and (2) an amount by which the first distance is greater than the second distance; and determine a bond index indicative of an adherence of cement to the casing based on the waveform data and the casing amplitude reduction data.

12. The system according to claim 11, wherein the processor is to:

calculate a quality control indicator for the quantitative cement evaluation; and check the bond index based on the quality control indicator.

13. The system according to claim 11, wherein the processor is to perform time-lapse measurements of the cement evaluation for a plurality of jobs associated with drilling the wellbore.

14. A logging-while-drilling downhole sonic tool, comprising:

a transmitter;

an array including a plurality of axially spaced acoustic transducers to detect acoustic signals propagating through a casing during a job associated with drilling a wellbore, the transmitter and the array spaced apart at a first distance; and a processor to:

receive waveform data of the acoustic signals;

detect an attenuation a casing amplitude from the measured waveform data, wherein the casing amplitude is an amplitude of a first acoustic signal propagating through the casing at the first distance;

calculate casing amplitude reduction data based on (1) a second acoustic signal propagating through the casing for a transmitter-receiver spacing at a second distance less than the first distance and (2) an amount by which the first distance is greater than the second distance; and determine a bond index indicative of an adherence of cement to the casing, based on the waveform data and the casing amplitude reduction data.

15. The logging-while-drilling downhole sonic tool according to claim 14, wherein the processor is to:

calculate a quality control indicator for the quantitative cement evaluation; and check the bond index based on the quality control indicator.

* * * * *